United States Patent [19]

Gatt

[11] 4,198,888

[45] Apr. 22, 1980

[54] SLICING APPARATUS

[75] Inventor: Frank R. Gatt, Box Hill, Australia

[73] Assignee: Charles Anthony Gatt, et al., Box Hill, Australia

[21] Appl. No.: 921,734

[22] Filed: Jul. 3, 1978

[30] Foreign Application Priority Data

Jul. 6, 1977 [AU] Australia ..... PD0726

[51] Int. Cl.[2] ..... B26D 4/42; B26D 7/16

[52] U.S. Cl. ..... 83/467 R; 83/607; 83/651.1

[58] Field of Search ..... 83/607–609, 83/651.1, 467, 468

[56] References Cited

U.S. PATENT DOCUMENTS

| | | | |
|---|---|---|---|
| 337,270 | 3/1886 | Kelsey | 83/607 X |
| 1,243,448 | 10/1917 | Royal | 83/607 |
| 2,102,170 | 12/1937 | Stern | 83/607 X |
| 2,144,557 | 1/1939 | Youngberg | 83/607 |
| 2,255,812 | 9/1941 | Rickman | 83/607 X |

*Primary Examiner*—Frank T. Yost

*Attorney, Agent, or Firm*—Learman & McCulloch

[57] ABSTRACT

Food slicing apparatus which includes a dismantable combination of a plate, a slicing arm and a thickness gauge. An edge of the plate is aligned with the arc of the slicing arm and the thickness gauge is adjustable to allow for accurate cutting of various thicknesses.

4 Claims, 4 Drawing Figures

SLICING APPARATUS

This invention relates to a slicing apparatus for foodstuffs.

There is a need for an effective all purpose slicing apparatus for domestic use which allows variable thicknesses to be produced and which is inexpensive, easy to clean and maintain and is robust. Commercial slicers generally use a circular rotating knife and are large cumbersome devices difficult to clean and maintain. Guillotine slicers have been made but these provide no means for controlling the regularity of slice thickness.

In order to overcome these difficulties the present invention provides a manually operable food slicing apparatus comprising:

(a) a support structure (b) a plate removeably mounted on said support structure and having a straight edge portion (c) cutting means removeably mounted on said support structure and adapted to pivot about a point, on said support structure, adjacent one end of said straight edge portion of said plate, said cutting means moving in a plane perpendicular to said straight edge portion, and (d) gauge means comprising a tongue portion extending into said support structure beneath said plate and an end stop having a face parallel to said straight edge portion of said plate, wherein movement of said tongue portion relative to said support means varies the distance between said straight edge portion and said face of said end stop.

The stop means controls the thickness of each slice as the food stuff to be sliced, e.g. a block of cheese, is moved up to the stop for each slice and the arm is brought down to provide consistent thicknesses for each slice.

A preferred aspect of the invention is to provide slicing apparatus which is easily disassembled for cleaning. Also it is preferable to provide on the slicing arm means to enable a number of cutting blades or wires to be used. Alternatively a series of slicing blades can be attached to the pivot point at one end of the straight edge of the base.

A preferred embodiment of the invention will now be described with reference to the accompanying drawings.

Figure 1:
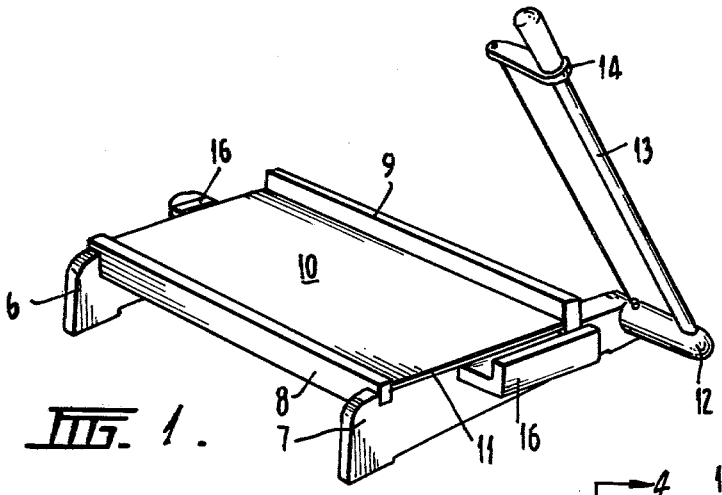
FIG. 1 is an isometric view of the food slicer which in this case is suitable for cheese or substances of like consistency.
Figure 2:
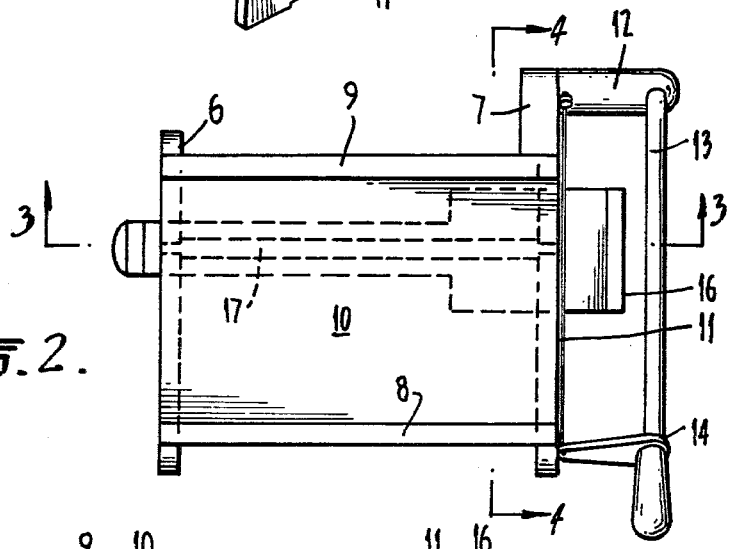
FIG. 2 is a plan view of the slicer.
Figure 3:
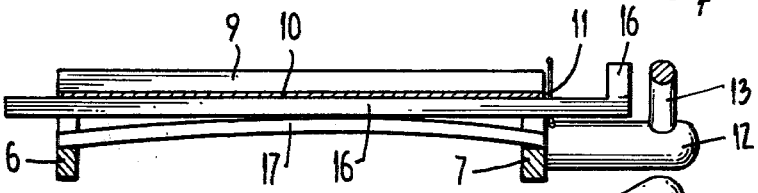
FIG. 3 is a sectional view along the line 3—3 of FIG. 2
Figure 4:
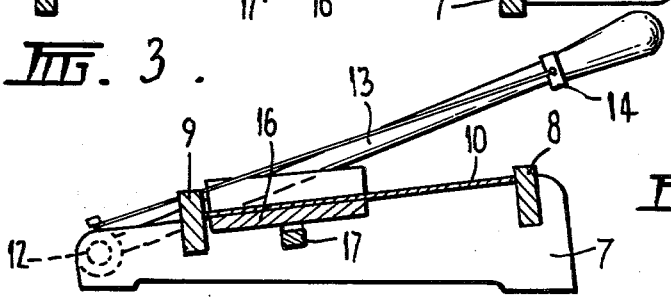
FIG. 4 is a sectional view along the line 4—4 of FIG. 2.

The slicer comprises parallel supports 6 and 7 spaced apart by lateral bar members 8 and 9 which in turn support the base plate 10. This base plate 10 is supported at its side edges within longitudinal confronting grooves in members 8 and 9.

Support 7 carries pivot hinge 12 for slicer arm 13. The straight edge 11 of base plate 10 is aligned with the face of support 7.

Slicer arm 13 fits within the hinge 12 which is rotatably mounted in the end of the support 7. In the embodiment shown in FIG. 1 slicer arm 13 carries wire strainer 14. The cutting wire is hooked onto a support on hinge 12 and then clipped onto the strainer 14. The wire can then be tightened to provide the necessary tension for slicing.

Beneath base plate 10 is located the adjustable stop 16 which is slidably engaged by an intermediate part of a curved spring rod 17 which is fixed at either end to supports 6 and 7. The end of the stop 16 remote from the straight edge 11 carries lateral grooves which are a measure of units of slice thickness. By depressing this remote end of the stop 16 and applying slight longitudinal pressure the stop 16 can be moved in fixed increments to any selected position to vary the width of slice required.

A modification of this invention allows for the use of cutting blades as well as slicing wires. In this embodiment (not shown) the hinge is provided with a bracket extending radially from the hinge. In this embodiment the cutting blades include a ring hook at one end which slips into the bracket on the hinges. This provides a pivot point for the cutting blade. It is convenient in this embodiment for the bracket to be located on the hinge 12 in a position which is exposed when the slicer arm 13 is lying at 180° to the base plate. In this way the slicer arm 13 need not be detached when a cutter blade is attached to the bracket. Alternatively the cutter blade can replace the slicer arm 13 entirely, as the hinge is detachable from the support 7. In such an arrangement the cutter blades function in the same manner as slicer arm 13.

The wires or blades can easily be removed for cleaning or replacement. Further the base plate 10 can be slid from its grooves whenever it requires cleaning. Removal of base plate 10 exposes the stop 16 and allows it to be cleaned and maintained. The stop 16 can also be removed and cleaned once base plate 10 is removed.

The base plate 10 can be of wood, any suitable metal or a suitable plastic such as high density polypropylene or high density polyethylene. The supports 6 and 7 and spacers 8 and 9 can likewise be of wood, metal or plastic.

Other variations in design are possible within the broad principle of this invention which is a combination of a pivotal slicer arm and an adjustable stop. It can be seen from the above description that the combination enables an inexpensive domestic adjustable slicing apparatus to be made which provides all of the advantages of larger more expensive rotary slicers.

I claim:

1. A manually operable food slicing apparatus comprising a support structure; a flat cover plate removably mounted on said support structure and terminating at least at one end in a straight edge; cutting means removably hinged to said support structure for swinging movements in a plane perpendicular to that of said plate and alongside said straight edge; an elongate tongue slidably and removably supported by said support structure beneath said plate, one end of said tongue extending beyond said straight edge of said plate; a stop member carried by said tongue at said one end of the latter, said stop member upstanding from said tongue a distance sufficient to enable said stop member to project above said plate; and resilient means reacting between said support structure and said tongue for releasably maintaining the latter in a selected position of adjustment relative to said support structure and in which position said stop member is releasably maintained in a selected position spaced from said straight edge of said plate.

2. Apparatus according to claim 1 wherein the other end of said tongue also projects beyond said plate, said other end of said tongue having indicia indicative of the spacing between said stop member and said straight edge.

3. Apparatus according to claim 1 wherein said support structure includes a pair of spaced, parallel bars having confronting grooves in which said plate is accommodated.

4. Apparatus according to claim 1 wherein said resilient means comprises a bowed spring having its opposite end supported by said support structure and having an intermediate portion thereof bearing against said plate.

* * * * *